US006631978B1

(12) United States Patent
Watanabe et al.

(10) Patent No.: US 6,631,978 B1
(45) Date of Patent: Oct. 14, 2003

(54) INK TANK HOLDING MEMBER AND INK JET CARTRIDGE PROVIDED WITH SUCH HOLDING MEMBER

(75) Inventors: Kenjiro Watanabe, Tokyo (JP); Osamu Morita, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/636,707

(22) Filed: Aug. 11, 2000

(30) Foreign Application Priority Data

Aug. 26, 1999 (JP) ..... 11-239831

(51) Int. Cl.[7] ..... B41J 2/01
(52) U.S. Cl. ..... 347/49
(58) Field of Search ..... 347/49, 85, 86, 347/87

(56) References Cited

U.S. PATENT DOCUMENTS

| | | | | |
|---|---|---|---|---|
| 5,619,237 A | | 4/1997 | Inoue et al. | 347/86 |
| 5,778,272 A | * | 7/1998 | Rosenburgh et al. | 396/564 |
| 5,940,102 A | | 8/1999 | Watanabe et al. | 347/86 |
| 6,179,415 B1 | * | 1/2001 | Okazaki et al. | 347/86 |
| 6,398,352 B1 | * | 6/2002 | Morita | 347/86 |

FOREIGN PATENT DOCUMENTS

| | | | |
|---|---|---|---|
| EP | 639462 | | 2/1995 |
| EP | 1 078 768 | * | 2/2001 |
| JP | 59-156756 | | 9/1984 |
| JP | 8-58107 | | 3/1996 |
| JP | 9-262988 | | 10/1997 |
| WO | 98/31548 | | 7/1998 |

OTHER PUBLICATIONS

Application No. 09/640,379, filed Aug. 17, 2000 (GAU 2861).

* cited by examiner

*Primary Examiner*—Michael Nghiem
(74) *Attorney, Agent, or Firm*—Fitzpatrick, Cella, Harper & Scinto

(57) ABSTRACT

An ink tank holding member for holding ink tanks containing ink is made freely attachable and detachable, at the same time, having ink lead-out members for leading out ink from ink supply ports provided for the ink tanks. For this ink tank holding member, gap complementary members are made mountable to complement the difference in shapes of ink tanks to be installed on the holding member. With the structure thus arranged, it becomes possible to use the ink tank holding member for each of the cartridges commonly, hence attempting the common use of parts, at the same time, preventing effectively the ink tanks from being inclined by the provision of the gap complementary members, thus enhancing the reliability of ink supply portion, as well as preventing the degradation of performance that may be caused by erroneous insertion of ink tanks.

4 Claims, 7 Drawing Sheets

INK TANK HOLDING MEMBER AND INK JET CARTRIDGE PROVIDED WITH SUCH HOLDING MEMBER

BACKGROUND OF THE INVENTION

1. Field of the Invention

The present invention relates to an ink tank holding member that holds an ink tank used for an ink jet recording apparatus. The invention also relates to an ink jet cartridge having such holding member provided therefor, which discharges ink for recording as well.

2. Related Background Art

FIG. 7 is a perspective view which illustrates an ink jet cartridge used for the conventional ink jet recording apparatus generally in use.

In FIG. 7 a reference numeral 1 designates an ink discharge unit provided with a plurality of ink discharge ports 14 for discharging ink, and 2, an ink discharge unit holding member that holds the ink discharge unit. When the ink discharge unit holding member 2 is coupled with the ink tank holding member (ink tank holder) 3 that holds an ink tank, ink in the ink tank installed inside the ink tank holder 3 is supplied to the ink discharge unit 1 held by the ink discharge unit holding member 2.

The ink tank installed on the ink tank holder is detachably mountable on the ink tank holder, and depending on the kind of an ink jet recording apparatus, there is the one having a plurality of ink tanks mounted on one ink jet cartridge. Then, the structure is arranged to make the ink jet cartridge detachably mountable on the recording apparatus in consideration of the case where recording head units should be replaced for the recording apparatus for some reasons.

In recent years, when recording is performed by use of an ink jet recording apparatus, there is often encountered the case where a single recording apparatus should operate for a number of different uses, such as, recording mainly characters to produce a business document or recording photographic images, among some others.

For such a recording apparatus, ink of different kinds are used depending on the intended way of uses. Then, ink jet cartridges each with the ink tank that contains ink should be replaced in some cases to make each of them optimally usable for the purpose.

Here, it is desirable to configure the outer shape the same for each of the ink jet cartridges which is optimized for the respective usages in order to simplify the mechanism of the installation unit for the ink jet cartridge of a recording apparatus. On the other hand, however, the shape should be made different for each of the ink tanks to be housed by the respective cartridges because of the amount of ink to be used, respectively, for the cartridge that mounts a plurality of ink tanks in particular.

As a cartridge of the kind, the inventors hereof have produced the cartridges shown in FIGS. 6A and 6B which serves as the background art for the present invention, respectively.

FIG. 6A shows a regular ink jet cartridge 12 which is used for printing usual documents and graphics, and which is used for forming images by ink of four colors using a pigment black ink tank 4, a dyestuff cyan ink tank 5, a dyestuff magenta ink tank 6, and a dyestuff yellow ink tank 7. As the pigment black ink tank 4 is often used for printing usual characters, its size is made larger than the other color ink tank so as to contain ink in a large amount. FIG. 6B shows a photo-ink jet cartridge 13 which is mainly used for highly precise printing such as to produce photographic images, and which is used for the formation of images by ink of four colors using a dyestuff black ink tank 8, a dyestuff cyan ink tank 9, a dyestuff magenta ink tank 10, and a dyestuff yellow ink tank 7. The dyestuff black ink tank 8 is not often used for printing characters. Therefore, the size of ink tank used for it here is the same as the usual size adopted for the other ink tanks.

In FIGS. 6A and 6B, the size of ink tank is made different is only for the pigment black ink tank 4 and the dyestuff black in k tank 8. Therefore, with a space for the pigment black in tank 4 is made available for the ink tank holder 3, th dyestuff black ink tank 8 is readily mountable on such space with excessive spaces on both side thereof, because it is smaller than the other. In this way, the ink discharge unit 1, the holding member 2, and the ink tank holder 3 can be shared by the regular ink jet cartridge 12 and the photo-ink jet cartridge 13 for use, although the kinds of ink tanks are different, hence making it possible to attempt common use of parts, and manufacturing process as well.

Nevertheless, in accordance with the aforesaid background art, the gap should be made on either side of the dyestuff black ink tank 8 for the photo-ink jet cartridge 13, which makes it difficult to position the ink tank 8. There is particularly a tendency that it is inclined sideways. Here, for the connection of ink flow paths of the ink tank 8 and the ink tank holder 3, it is arrange to press an ink absorbent provided for the ink tank 8, and the mesh filter provided for the ink tank holder 3 side to be in contact with each other. However, if the ink tank is inclined, a problem is encountered that the reliability of the connected portion of the ink tank becomes unfavorable. Also, the shape of the dyestuff black ink tank 8 is different from that of the pigment black ink tank 4, but there is still a possibility that these tanks are inserted erroneously. Particularly when the pigment black ink tank 4 should be inserted erroneously into the photo-ink jet cartridge 13, there is a fear that the original performance of the photo-ink jet cartridge 13 cannot be regained even if it is replaced with the dyestuff black ink tank 8 again as intended, because the properties of ink materials thereof are largely different.

SUMMARY OF THE INVENTION

The present invention is designed in consideration of the problems discussed above. It is an object of the invention to provide an ink tank holding member capable of enhancing the reliability of ink connecting portions by stabilizing the installing positions of ink tanks with a simple structure, as well as capable of preventing the erroneous insertion of ink tanks that may cause the degradation of the performance, and also to provide an ink jet cartridge provided with such ink tank holding member.

In order to achieve the objectives described above, the ink tank holding member of the invention for holding ink tanks containing ink is made freely attachable and detachable, at the same time, having ink lead-out members for leading out ink from ink supply ports provided for the ink tanks. For this ink tank holding member, gap complementary members are made mountable to complement the difference in shapes of ink tanks to be installed on the holding member.

With the structure thus arranged, it becomes possible to use the ink tank holding member for each of the cartridges commonly, hence attempting the common use of parts, as the same time, preventing effectively the ink tanks from being inclined by the provision of the gap complementary members. As a result, the reliability of ink supply portion is enhanced, and also, the degradation of performance that may be caused by erroneous insertion of ink tanks can be prevented.

Particularly, with the provision of plural coupling holes for the holding member to hold the ink tanks, and the gap complementary members configured to be symmetrical to the line that connects the plural coupling holes, it becomes possible to prevent the ink tanks from being inclined more effectively.

Also, the gap complementary members are provided with coupling nails, and at the same time, the holding member is provided with coupling holes corresponding to these coupling nails to make it possible, as an advantage, among others, to effectuate assembling easily by use of an automatic system, as well as to make adjustment thereof with ease.

Also, an ink jet cartridge of the present invention is provided with the aforesaid ink tank holding member, and arranged to receive ink from the ink lead-out members of the ink tank holding member, at the same time, having ink discharge ports for discharge ink.

DETAILED DESCRIPTION OF THE PREFERRED EMBODIMENTS

Hereinafter, with reference to the accompanying drawings, the embodiments of the present invention will be described in detail.

Figure 1A:
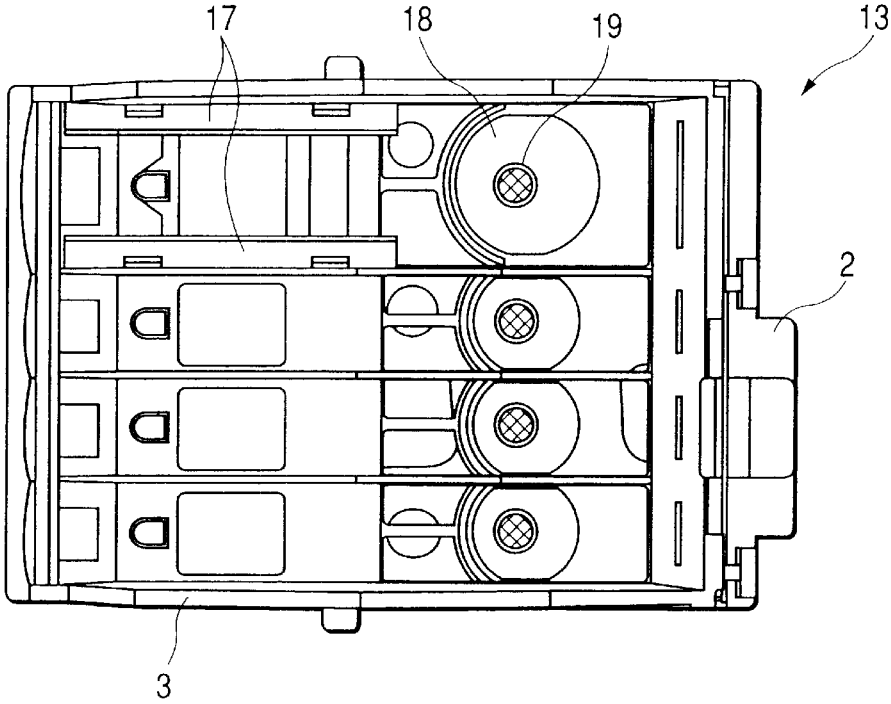
FIGS. 1A and 1B are plane views which illustrate the structures of the ink jet cartridges each having the ink tank holding member of the present invention, respectively.
Figure 1B:
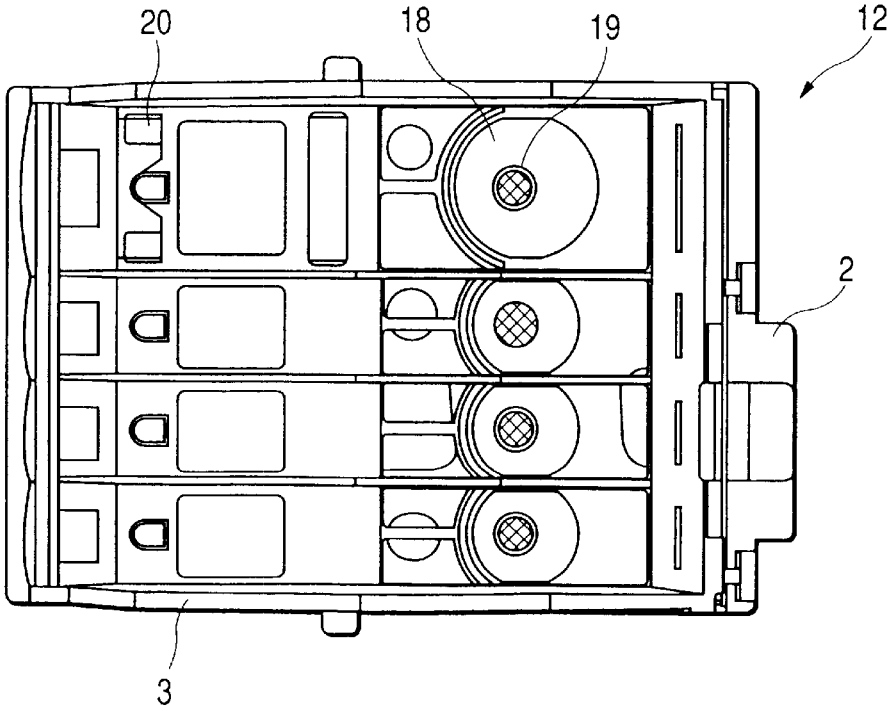

FIGS. 1A and 1B are plane views which illustrate the ink jet cartridges representing the features of the present invention most suitably in a state where no ink tanks are installed on them. FIG. 1A shows a four-color photo-ink jet cartridge 13. FIG. 1B shows a four-color regular ink jet cartridge 12. For the photo-ink jet cartridge 13, the holding member 2 that holds an ink discharge unit, and an ink tank holder 3 are coupled, and then, ink connection is formed with the ink tanks through each of mesh holders 19. Airtightness is kept between the ink tanks and ink tank holder 3 by means of each of sealing rubbers 18. On the installation position of the black ink tank of the photo-ink jet cartridge 13, spacers 17 are installed each as a member for complementing the respective spaces. On the other hand, no spacers 17 are provided for the regular ink jet cartridge 12.

Figure 2A:
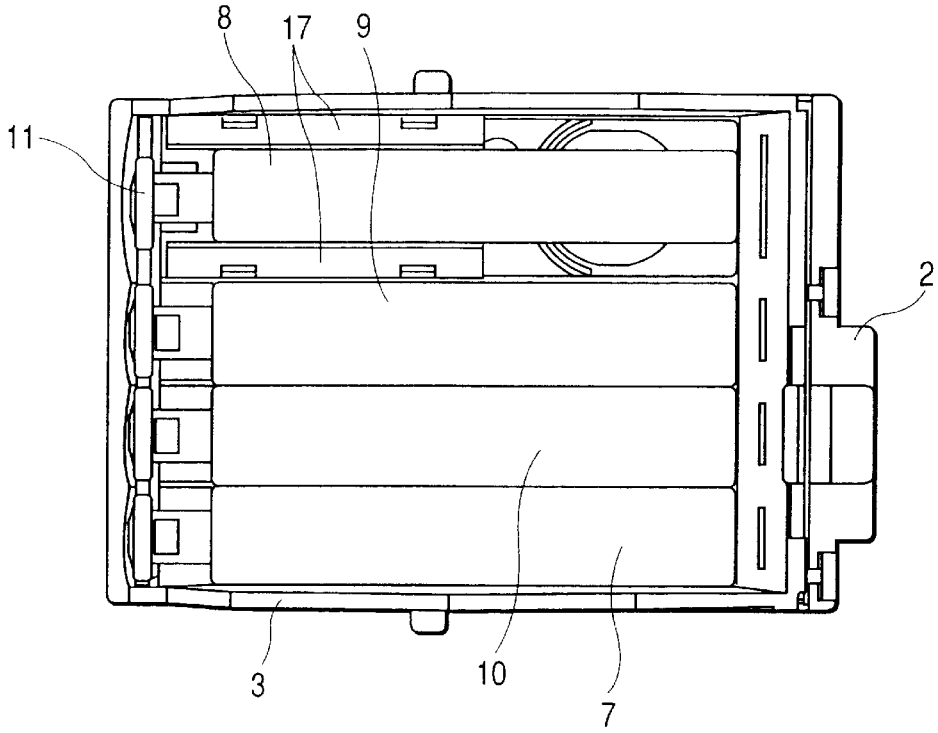
FIGS. 2A and 2B are plane views which illustrate the states of installing ink tanks on the ink jet cartridges each provided with the ink tank holding member of the present invention, respectively.
Figure 2B:
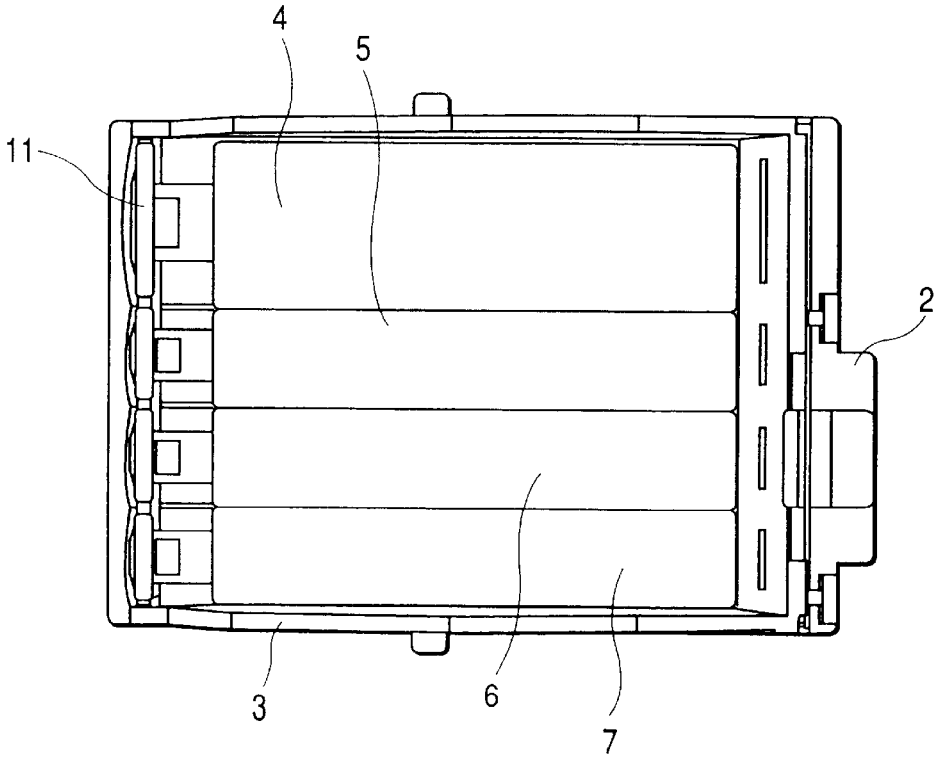

FIGS. 2A and 2B are plane views which illustrate the state where ink tanks are installed on each of the ink jet cartridges in accordance with the present invention. For the four-color photo-ink jet cartridge 13, a dyestuff black ink tank 8, a dyestuff cyan ink tank 9, a dyestuff magenta ink tank 10, and a dyestuff yellow ink tank 7 are installed on the respective positions. Each of installation nails 11 pressed to be bent to attach the ink tanks to or detach them from the ink tank holder 3. The dyestuff black ink tank 8 is fixed between two wall faces of the spacers 17 when installed therebetween. Therefore, it is stably installed without movement or inclination in the side direction. Also, with the presence of the spacers 17, the pigment black ink tank 4 cannot be installed on the photo-ink jet cartridge 13, making it possible to reliably prevent any erroneous installation thereof. Also, for the regular ink jet cartridge 12 which is not provided with any spacers 17, a pigment black ink tank 4, a dyestuff cyan ink tank 5, a dyestuff magenta ink tank 6, and a dyestuff yellow ink tank 7 are installed without any gaps between them.

Figure 3A:
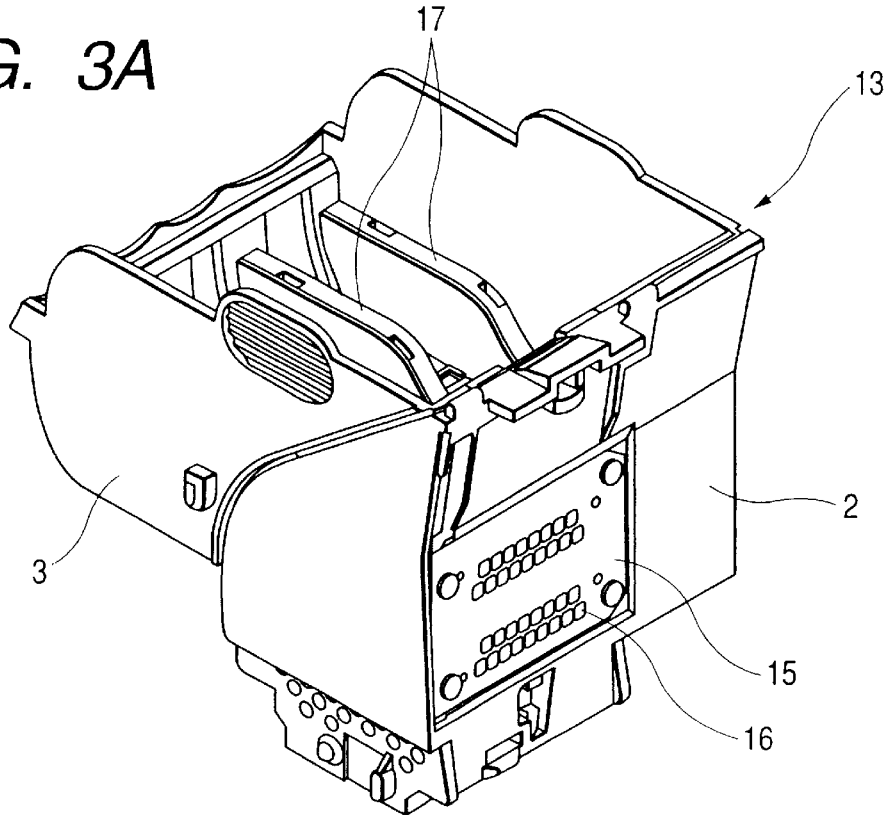
FIGS. 3A and 3B are perspective views which illustrate the structures of ink jet cartridges each provided with the ink tank holding member of the present invention, respectively.
Figure 3B:
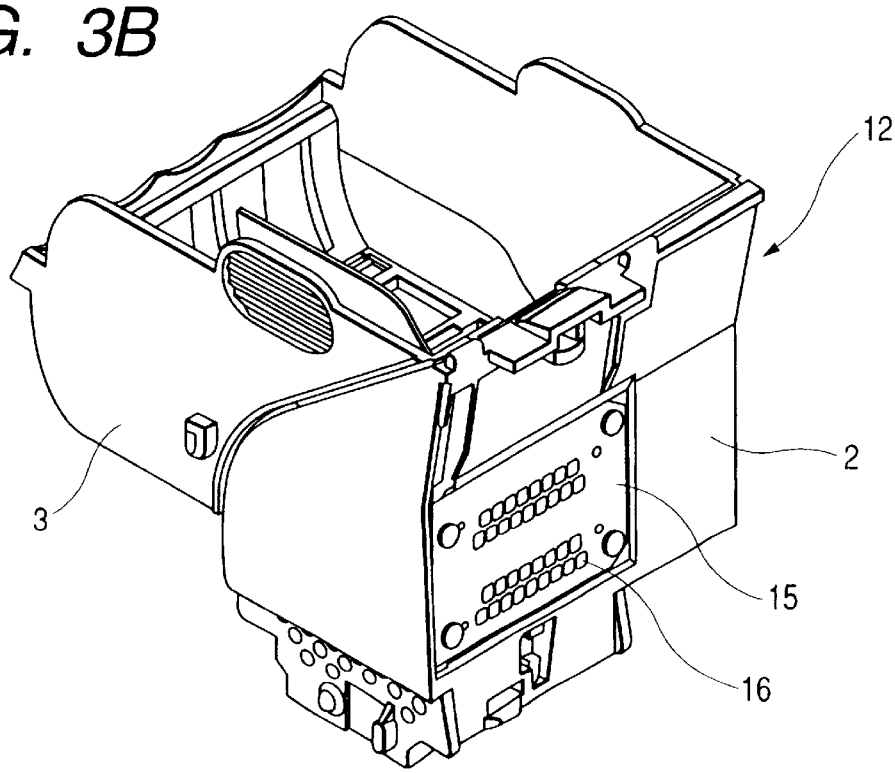

Here, the ink tanks and the ink tank holder shown in FIGS. 2A and 2B, each of the ink tanks is provided with an installation nail 11, and a coupling nail (not shown) arranged on the plane that faces the plane having the installation nail as disclosed in the specification of Japanese Patent Application Laid-Open No. 08-58107. Then, on the ink tank holder, coupling holes (not shown) are provided corresponding to teach of them to make it possible to hold each of the ink tanks thereby. The spaces 17 of the present invention are structured to be configured substantially symmetrical to the line that connects these coupling holes. As a result, it becomes possible to fill in the gaps between the tank holder, and the both side faces of the dyestuff black ink tank 8 reliably in the longitudinal direction thereof. FIGS. 3A and 3B are perspective view which illustrate the ink jet cartridges of the present invention. FIG. 3A shows the photo-ink jet cartridge 13 provided with the spaces 17. FIG. 3B shows the regular ink jet cartridge 12 which is not provided with any spacers 17.

With the spacers thus provided for both gaps formed by the side faces of a dyestuff black ink tank installed on the ink tank holder of a photo-ink jet cartridge, it becomes possible to prevent the ink tank from being inclined, and enhance the reliability of the ink connecting portion. Also, with the presence of the spacers, it becomes impossible for a pigment black ink tank to be installed on a photo-ink jet cartridge, hence preventing the degradation of its performance that may be brought about by erroneous insertion thereof.

Figure 4A:
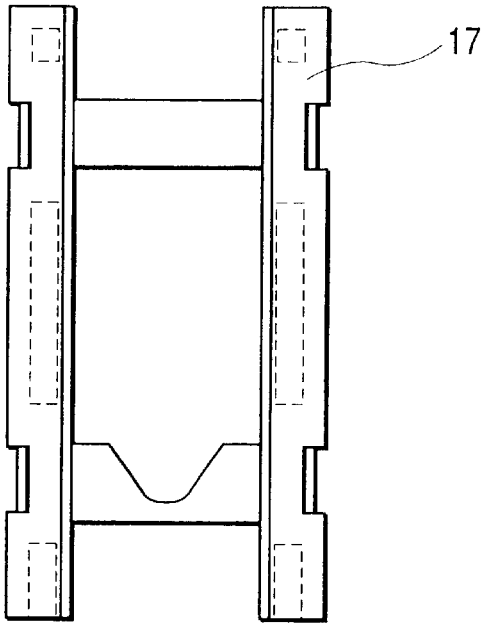
FIGS. 4A, 4B and 4C are views which illustrate three phases of spacers in accordance with the present invention.
Figure 4B:
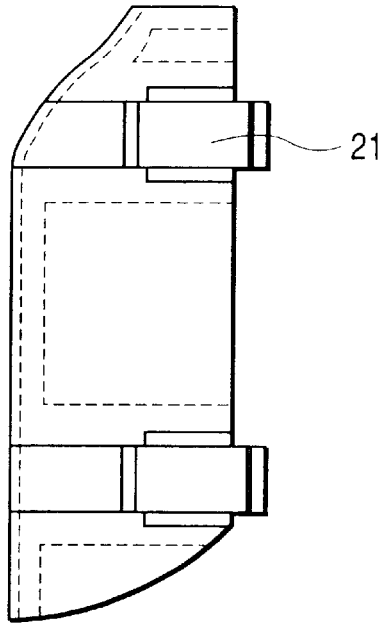
Figure 4C:
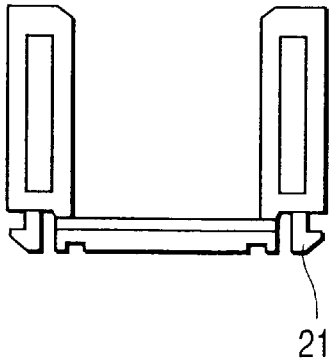
Figure 5A:
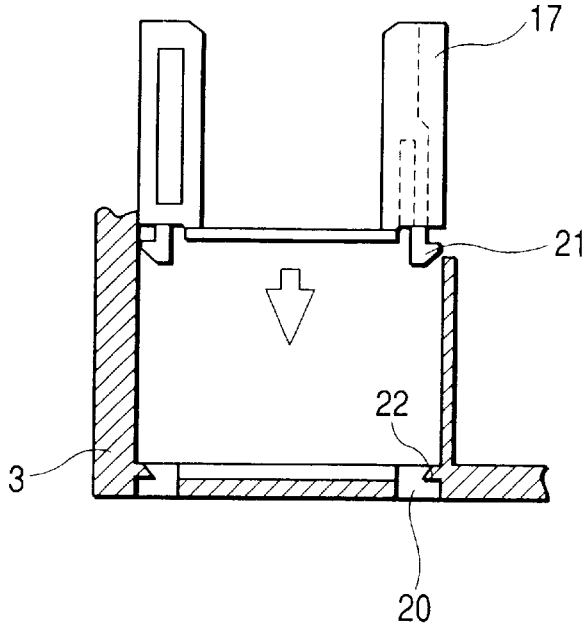
FIGS. 5A and 5B are views which illustrate the method for installing the space on the ink tank holder in accordance with the present invention.
Figure 5B:
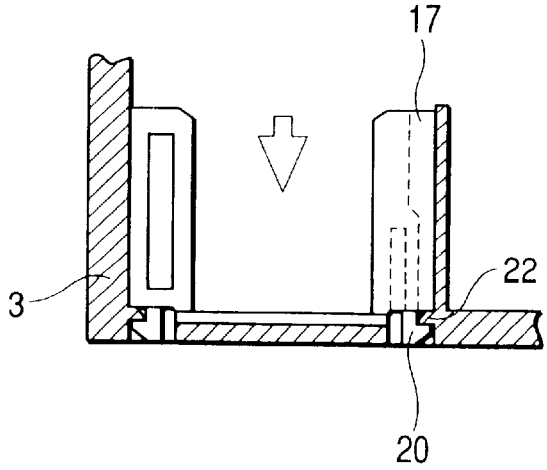
Figure 6A:
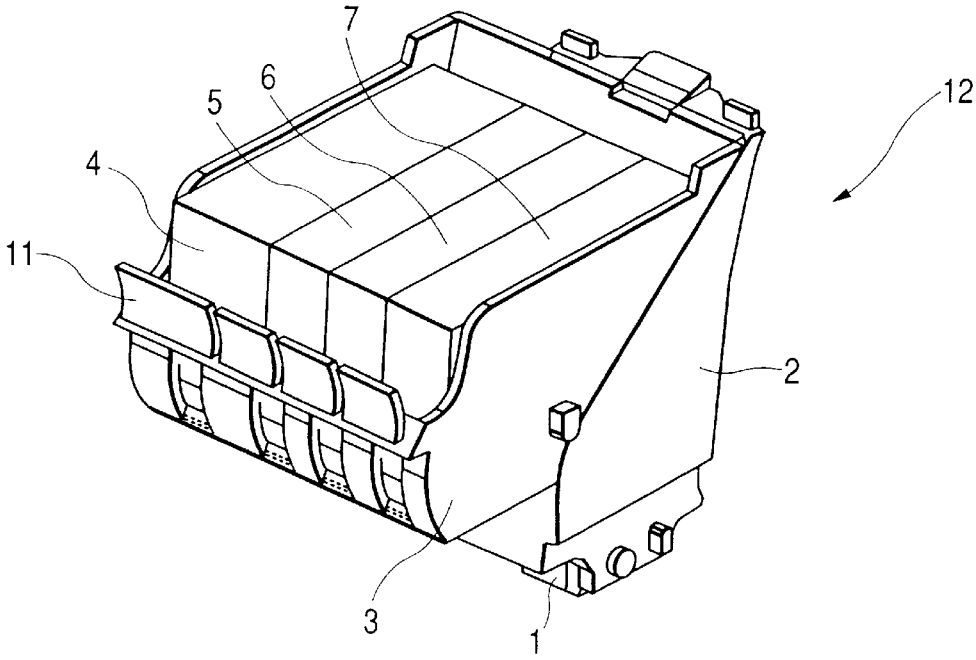
FIGS. 6A and 6B are perspective views which illustrate ink jet cartridges which represent the background art of the present invention.
Figure 6B:
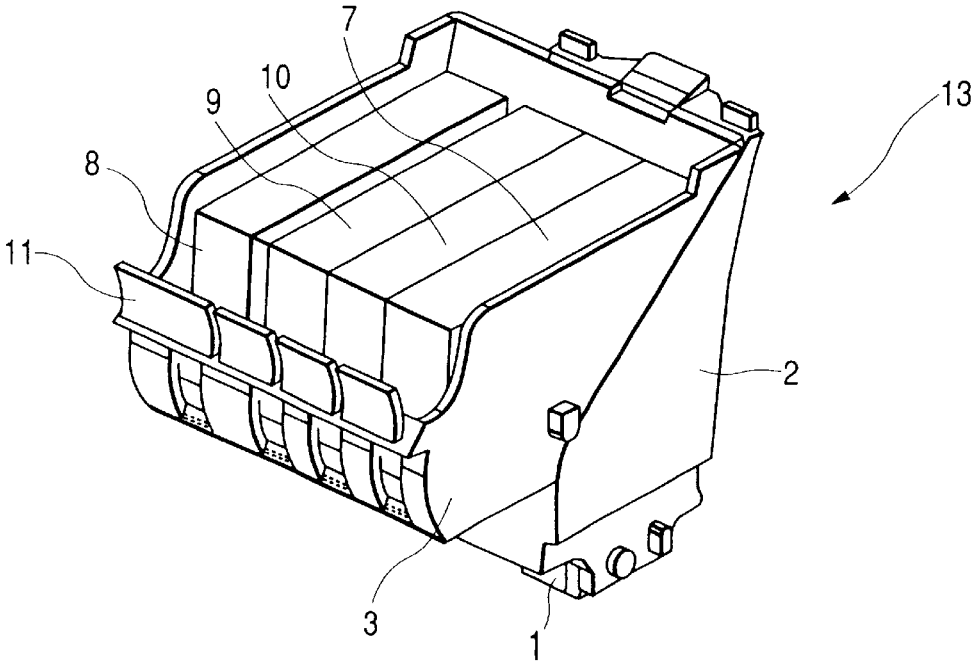
Figure 7:
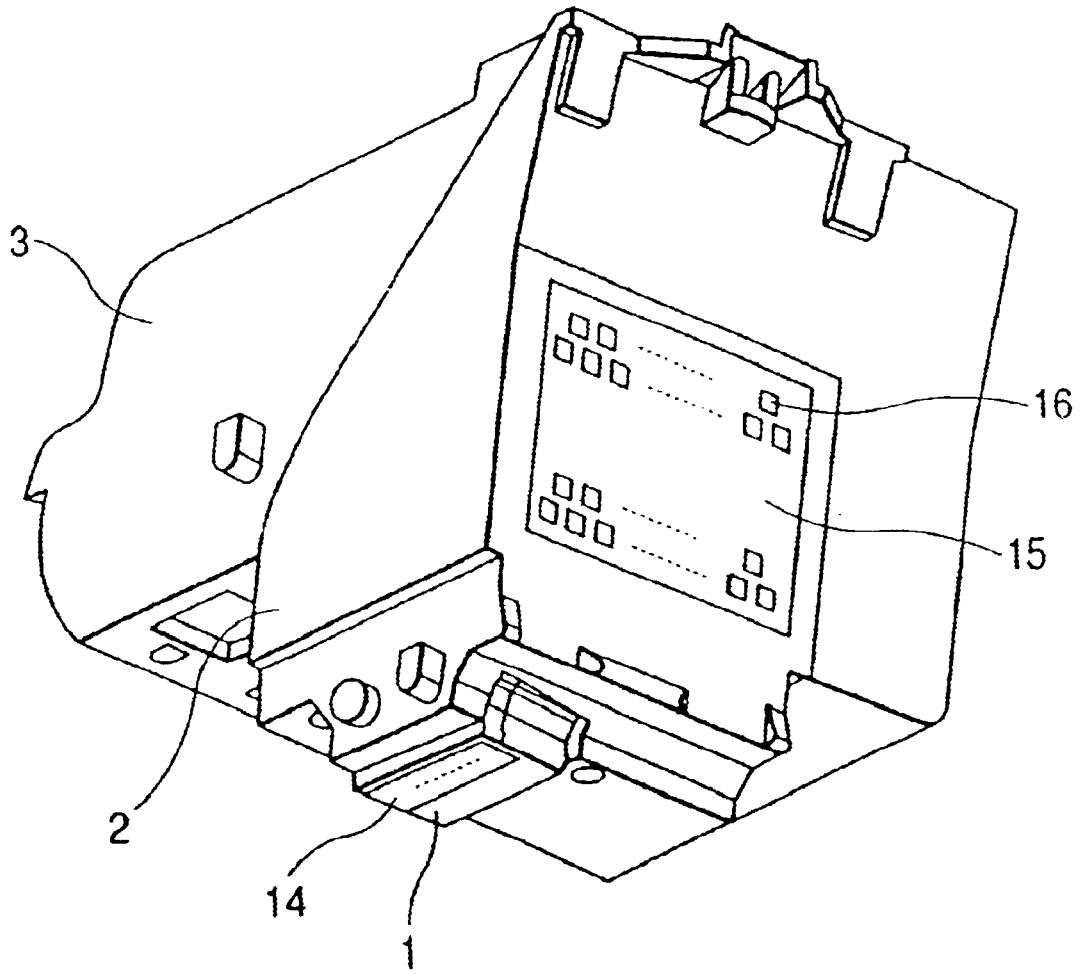
FIG. 7 PRIOR ART
FIG. 7 is a perspective view which illustrates the conventional ink jet cartridge.

FIGS. 4A to 4C are views which show three phases of spacers 17 in accordance with the present invention. FIG. 4C is a front view which shows the structure in which the spacers 17 are integrally formed with two wall faces, and on the bottom face, four hooking assemble feet 21 are provided as coupling nails. FIGS. 5A and 5B are views which illustrate the installation method of the invented spacers 17 on the ink tank holder 3. FIGS. 5A and 5B are cross-sectional views which illustrate the installing positions of the spacers 17 on the ink tank holder 3. On the installing positions of the spacers 17 on the ink tank holder 3, the hooking type assemble hooks 22 are arranged to assemble and couple the assembling feet 21 of the spacers 17 with the assembling holes 20 that serve as the coupling holes corresponding to the coupling nails. The spacers 17 are inserted from above into the ink tank holder 3, and the assembling feet 21 are bent to be fitted into the assembling holes 20. Thus, as shown in FIG. 5B, the hooking assemble feet 21 and the assembling hooks 22 engage with each other to fix them firmly. Since the firm fixation is possible just by exerting pressure from above, it becomes possible to deal with the spacers easily by means of an automatic assembling or to make adjustment thereof with ease.

Also, the photo-ink jet and regular ink jet cartridges differ from each other just in the presence or absence of the spacers. Therefore, it is possible to effectuate the common use of the parts and manufacturing processes for them, and reduce the costs of manufacture significantly. Here, by use of the tank holding member of the present invention, spacers can be installed as the tank holding member immediately after the completion of inspection process. Here, the required performances differ for the photo-cartridge and the regular cartridge, but after both of them have been manufactured without any distinction between them by use of the tank holding members of the present invention, decision can be made on whether one of them should be used for a photo-cartridge or for a regular cartridge depending on the result of product inspection. Then, only for those to be used as the photo-cartridges, the spacers are installed. In this manner, it becomes possible to maximize the reduction of the number of defective products.

In this respect, the description has been made of the structure in which the recording head unit is formed integrally with the ink tank holder, but it is of course possible to arrange the structure so that the ink tank holder, which serves as the ink tank holding member, is made independent of the recording head unit.

Here, in accordance with the description has been made above, the present invention makes it possible to use the ink tank holding members for each of the cartridges commonly. Not only the common use of parts becomes possible, but also, the inclination of ink tank can be prevented effectively by the provision of the gap complementary members. As a result, the reliability of ink supply portion becomes more enhanced, while preventing the degradation of performance that may ensue from the erroneous insertion of ink tank.

Particularly, with the arrangement of plural coupling holes on the holding member for holding ink tanks, while the gap complementary members are configured to be substantially symmetrical to the line that connects the plural coupling holes as its feature, it becomes possible to prevent the inclination of ink tank more effectively.

Also, the gap complementary members are provided with coupling nails, and at the same time, the holding member is provided with coupling holes corresponding to the coupling nails as its feature. Therefore, it becomes possible to execute assembling by use of an automatic system with ease. There is also an advantage that the adjustment thereof becomes easier.

What is claimed is:

1. An ink tank holding member for holding ink tanks containing ink, being made freely attachable and detachable, and comprising ink lead-out members for leading out ink from ink supply ports provided for said ink tanks, wherein gap complementary members are made mountable to complement the difference in shapes of ink tanks to be installed on said holding member, and wherein said holding member is provided with a plurality of coupling holes for holding said ink tanks, and said gap complementary members are configured to be substantially symmetrical to a line between said coupling holes.

2. An ink tank holding member according to claim 1, wherein said gap complementary members are provided with coupling nails, and said holding member is provided with coupling holes corresponding to said coupling nails.

3. An ink tank holding member for holding ink tanks containing ink, being made freely attachable and detachable, and comprising ink lead-out members for leading out ink from ink supply ports provided for said ink tanks, wherein gap complementary members are made mountable to complement the difference in shapes of ink tanks to be installed on said holding member, and wherein said gap complementary members are provided with coupling nails, and said holding member is provided with coupling holes corresponding to said coupling nails.

4. An ink jet cartridge comprising:

an ink tank holding member according to claim 3, and an ink discharge unit for receiving ink supply from the ink lead-out members of said ink tank holding member, and having discharge ports for discharging ink.

* * * * *